US005795183A

United States Patent [19]

Kameyama

[11] Patent Number: 5,795,183

[45] Date of Patent: Aug. 18, 1998

[54] CONNECTOR APPARATUS

[75] Inventor: Isao Kameyama, Shizuoka-ken, Japan

[73] Assignee: Yazaki Corporation, Tokyo, Japan

[21] Appl. No.: 728,606

[22] Filed: Oct. 10, 1996

[30] Foreign Application Priority Data

Oct. 13, 1995 [JP] Japan ..... 7-265702

[51] Int. Cl.[6] ..... H01K 13/60

[52] U.S. Cl. ..... 439/534; 439/528; 439/660

[58] Field of Search ..... 439/527, 528, 439/534, 540.1, 660

[56] References Cited

U.S. PATENT DOCUMENTS

| | | | |
|---|---|---|---|
| 908,751 | 1/1909 | Cooke | 439/534 |
| 3,193,793 | 7/1965 | Plunkett et al. | 439/660 |
| 4,737,118 | 4/1988 | Lockard | 439/660 |
| 4,904,199 | 2/1990 | Ducassou | 439/527 |
| 4,986,762 | 1/1991 | Keith | 439/534 |
| 5,639,261 | 6/1997 | Rutkowski et al. | 439/534 |

FOREIGN PATENT DOCUMENTS

| | | | |
|---|---|---|---|
| 8501751 | 1/1987 | Netherlands | 439/660 |

*Primary Examiner*—J. J. Swann

*Attorney, Agent, or Firm*—Finnegan, Henderson, Farabow, Garrett & Dunner, L.L.P.

[57] ABSTRACT

A connector apparatus 20 comprises two connectors 21. A terminal 5 remains accommodated in a terminal accommodating room 22*a* of a connector housing 22, and an electric contactor 6 of the terminal 5 is exposed outward from an upper opening 24. The connector apparatus further comprises a coupling member 33. Either end of the coupling member 33 is rotatably engaged in each side wall 25 of the connector housing 22 of the two connectors 21. Thus, the two connectors 21 are coupled so that it is possible to switch a position for overlapping one connector 21 on the other connector 21 in order to cover an upper side of the other connector 21 to a position for arranging both the connectors 21 in plane each other.

4 Claims, 2 Drawing Sheets

CONNECTOR APPARATUS

BACKGROUND OF THE INVENTION

1. Field of the Invention

The present invention relates to a connector apparatus which exposes an electric contactor of a terminal, and sets the exposed electric contactor on a conductor portion of a connecting component, for example, a switch etc., in order to contact the exposed electric contactor with the connecting component, so that the connecting components can be connected electrically.

2. Description of the Related Art

A conventional connector works by exposing an electric contactor of a terminal at an upper side and by contacting a conductor portion of a corresponding component with the exposed electric contactor. For example, such manner is disclosed in a laid-open Japanese patent publication No. 5-47442.

According to the conventional invention, many terminals are accommodated in a terminal accommodating room of a connector housing, and the terminals are locked by a lance. Each electric contactor of the terminals is exposed outward from an opening at an upper side of a connector housing. Each electric contactor protrudes in a direction which is transverse to a direction in which the terminal is inserted (as shown by an upper direction in FIGs). An electric wire is extended in a direction opposite to a direction in which the terminal is inserted. An upper side of the connector housing is surrounded by a U-shaped rim wall in plan which is higher than an upper side of the connector housing. By the rim wall, the electric contactor which is protrudes upward is protected. Furthermore, by use of other holders besides a lance, it is possible to prevent the terminal from slipping backward.

The connector is used as a connector for an instrument panel and is set on a car body. A switch is installed in a panel as it is. When a lock portion of the switch is locked to the panel, a conductor portion which is exposed at a lower side of the switch is contacted with an electric contactor existing at an upper side of the connector. Thereby, the switch can be connected to the connector electrically.

These kinds of connectors must arrange terminals in a row. Accordingly, when the number of poles increases, a shape width of a connector gets longer from side to side. Accordingly, there is a problem in that the size of the connector increases larger.

Therefore, two connectors are prepared. Both the connectors are arranged in plane and located in order to face their ends towards each other. The connectors are connected to each other by each lock which is installed in both the connectors. Thereby, the arrangements of terminals are arranged in two rows. In this case, each conductor portion which is laid at a lower side of a switch is contacted respectively toward an electrical contactor of terminals which are arranged in two rows. Thereby, it is possible to provide an electrical connection.

If two connectors are arranged, when keeping and carrying a connector apparatus, it is necessary to put a cover on each connector in order to protect an electrical contactor. Accordingly, there is a problem in that the number of components increases.

SUMMARY OF THE INVENTION

It is an object of the present invention to provide a connector apparatus which can set two connectors in two rows in use, and require only one protecting cover when keeping and carrying a connector apparatus.

According to one aspect of the invention, a connector apparatus including two connectors, each having a connector housing including upper and lower surfaces, wherein a terminal remains accommodated in a terminal accommodating room of the connector housing, and an electric contactor of the terminal is outwardly exposed through an upper opening in the upper surface of the connector housing; and a coupling member having two ends wherein each end of the coupling member is rotatably engaged with a respective side wall of a connector housing of one of the two connectors so as to couple the two connectors to one another in a manner permitting the coupled connectors to move from a first position, wherein the connectors lie in the same plane, to a second overlapping position, wherein the upper surface of the connector housing of one of the connectors is covered by and in contact with the lower surface of the other connector.

When carrying and keeping the connector apparatus, two connectors are overlapped. Thereby, since an upper side of one connector is covered with the other connector, an electrical contactor which is exposed at an upper side of one connector is protected by the other connector. Accordingly, a protecting cover for protecting an electric contactor is needed only for a connector which is laid at an upper side thereof. Therefore, one protecting cover is sufficient to cover the connector. Furthermore, when overlapping two connectors, a connector apparatus is changed to a compact shaped one. Accordingly, it is possible to use space efficiently when keeping and carrying a connector apparatus. When installing a connector apparatus in a car body the, two connectors which are overlapped are shifted to a parallel (planar) arrangement. Thereby, while two connectors remain coupled by a connecting material, the two connectors are arranged at a fixed position in a plane. According, it is not necessary to set a position between two connectors, and particularly to carry out other operations. While the two connectors remain unfolded in a plane, it is possible to set each connector on a portion upon which each connector is to be set. Accordingly, it is possible to contact the connecting components with two connectors, and to connect them electrically.

According to another aspect of the invention, a connector apparatus further comprises a detachable protecting cover for covering the electric contactor of the uppermost connector in the overlapping position.

According to a connector apparatus of the present invention, using only one protecting cover, it is possible to protect electric contactors of two connectors.

According to further aspect of the invention, a connector apparatus further comprises a plurality of terminals arranged in each connector, respective, so that terminal arrangements of the connectors are parallel to one another when arranging the two connectors to lie in a plane.

According to a connector apparatus of the present invention, a plurality of terminals are arranged in a each connector. Accordingly, when the two connectors are arranged in plane, two rows of terminals are arranged.

According to a further aspect of the invention, a connector apparatus includes two connecting portions between a side wall of the connector housing and the coupling member wherein an engaging bore forms one of the connecting portions, and an engaging protrusion portion is mounted in the other connecting portion, so that the engaging protrusion portion can be rotatably engaged by the engaging bore and detached from the engaging bore flexibly.

According to a connector apparatus of the present invention, if an engaging protrusion portion is engaged in an engaging bore, the two connectors are connected by a coupling member.

DETAILED DESCRIPTION OF THE PREFERRED EMBODIMENTS

A first embodiment of the present invention will be explained in detail with reference to FIG. 1.

Figure 1:
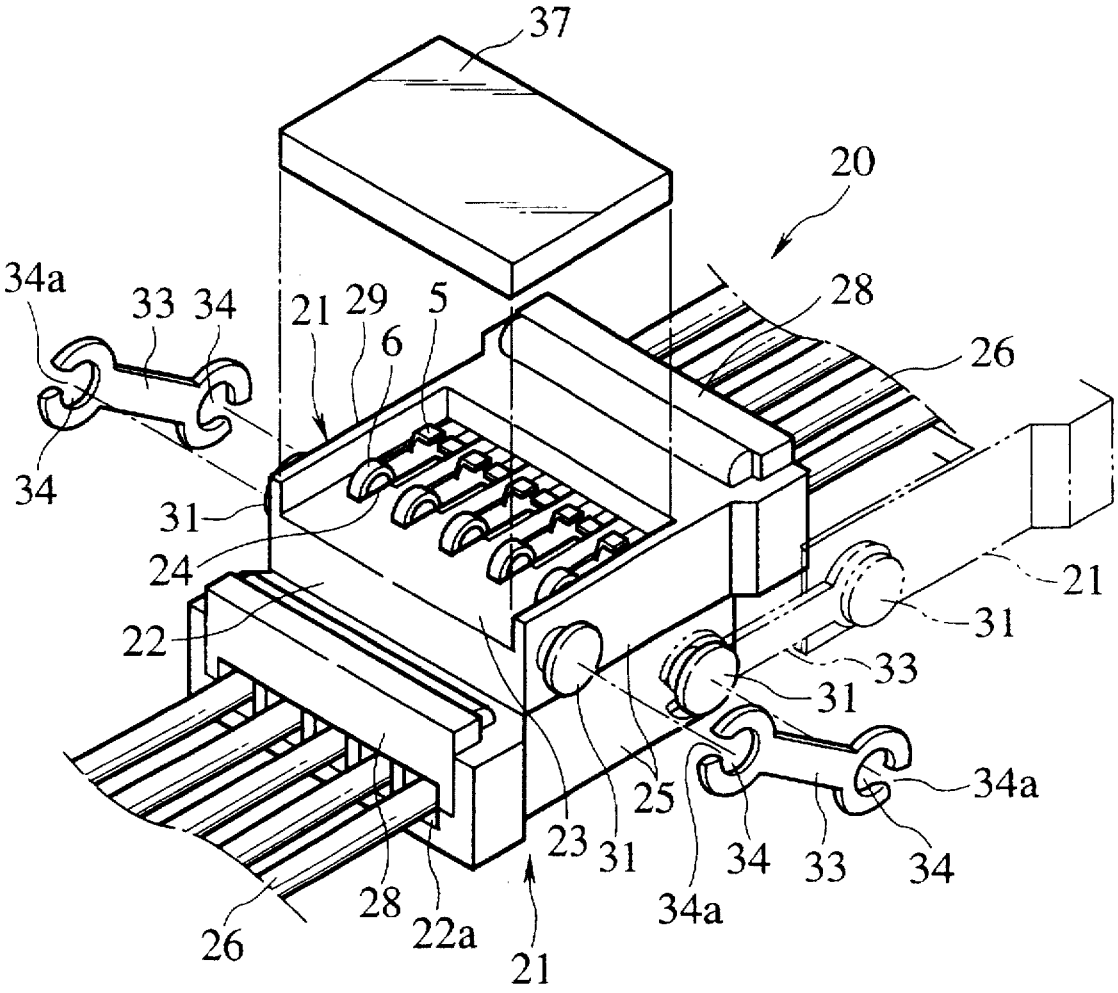
FIG. 1 is an exploded perspective view of a connector apparatus according to a first embodiment of the present invention.

As shown in FIG. 1 and according to a first embodiment of the present invention, a connector apparatus 20 comprises two connectors 21 whose shapes are same, and a pair of coupling member 33 for coupling the two connectors 21. One connector 21 is arranged opposite to the other connector 21. That is, each front end of the two connectors faces toward the other, so that two connectors are connected by the coupling member 33.

Each connector 21 has a connector housing 22 whose shape is square box, where many terminals 5 are incorporated in a terminal accommodating room 22*a* of the connector housing 22. Each terminal 5 is inserted from a back end opening of the terminal accommodating room 22*a*, where each terminal 5 is fixed. Each terminal 5 is arranged in a row and parallel a longitudinal direction of the connector housing 22 (a direction which is transverse to a direction which each terminal 5 is inserted into). An electric wire 26 connected to each terminal 5 extends backward from each terminal.

Each terminal 5 has an electric contactor 6 in the form of a spring. The electric contactor 6 is protrudes in a direction transverse to a longitudinal direction of each terminal 5 (a direction which each terminal 5 is inserted into). Each electric contactor 6 protrudes outward from an opening 24 whose shape is like a small window, and which is laid on an upper side 23 of the connector housing 22. A rim wall 29 which is little higher than a protrusion of the electric contactor 6 is installed around the upper side 23 of the connector housing 22. The upper side 23 is surrounded by the rim wall 29 whose shape is U-shaped in plan view. Thereby, the electric contactor 6 is protected. It is possible to allow a holder 28 which is installed at a back end of the connector housing 22 to prevent the terminal 5 from slipping backward.

An engaging pin (an engaging protrusion portion) 31 which includes a collar at each end is installed, respectively, at a predetermined position which is laid on either side wall 25 of the connector housing 22. An engaging bore 34 which engages the engaging pin 31 is installed at either end of the coupling member. Coupling member 33 has like a band and has a predetermined length. The circumference of the engaging bore 34 is not closed, having an opening 34*a*. The engaging bore 34 engages the engaging pin 31 in order to attach and detach flexibly.

Since the engaging bore 34 engages the engaging pin 31, the coupling member 33 can rotate between the two connectors 21. The two connectors 21 are coupled in order to allow the connectors to switch positions from a first position to a second position. A first position is a position where the two connectors 21 overlap so that an upper side of one connector 21 is covered with a lower side of the other connector 21 (as shown by a solid line). The second position is a position where the two connectors 21 are arranged in plane (as shown by a two dotted chain line). That is, a length of the coupling member 33 and a position of the engaging pin 31 is set so that the two positions can be switched. According to the first embodiment, when the two connectors 21 are set so that one connector 21 overlaps the other connector 21, where it is possible to prevent a portion of the holder 28 from overlapping. This has the benefit that the holder 28 can be opened and closed when the two connectors 21 remain in the overlapped position.

According to a connector apparatus 20 of the present invention, there is provided only one protecting cover 37 for covering an upper side of the upper connector 21 of the two overlapped connectors 21.

When carrying and keeping the connector apparatus 20, as shown in FIG. 1, the two connectors 21 are overlapped. Thereby, an upper side of a lower connector 21 is covered with an upper connector 21. Accordingly, by employing only one protecting cover 37 on the upper connector 21, it is possible to protect the electric contactor 6. Furthermore, if the two connectors 21 remain overlapped, since the connector 21 apparatus is compactly shaped, it is possible to use a space efficiently when carrying and keeping the connector apparatus 20.

Actually, the connector apparatus 20 is installed in a car body for example. In this case, while the two overlapped connectors 21 remain coupled to the coupling member 33, the two connectors 21 are shifted to be planar. Accordingly, the connectors 21 are unfolded to lie in a plane, as shown by a two dotted chain line. Thereby, since the coupling member 33 decides a positional relationship of the two connectors 21, either connector 21 may be arranged in a fixed position. Accordingly, it is not necessary to set a position between the two connectors, and to carry out other operation especially. While the connectors 21 remain unfolded in a planar position, it is possible to set the two connectors 21 on the portions which the two connectors are to be set. Accordingly, it is possible to contact a connecting component (for example a switch) with the electric contactor 6 which is arranged in two rows in the two connectors 21, and to connect electrically. Therefore, it is also possible to make a shape of a connecting component, for example, a switch compact.

According to the first embodiment of the present invention, the engaging pin 31 is installed at a side of the connector housing 22. The engaging bore 34 is set at a side of the coupling member 33. However, the present invention is not necessarily restricted to the embodiment as described above. In other words, the reverse case is allowed. That is, the engaging pin 31 may be installed at a side of the coupling member 33, and the engaging bore 34 may be set at a side of the connector housing 22.

Figure 2:
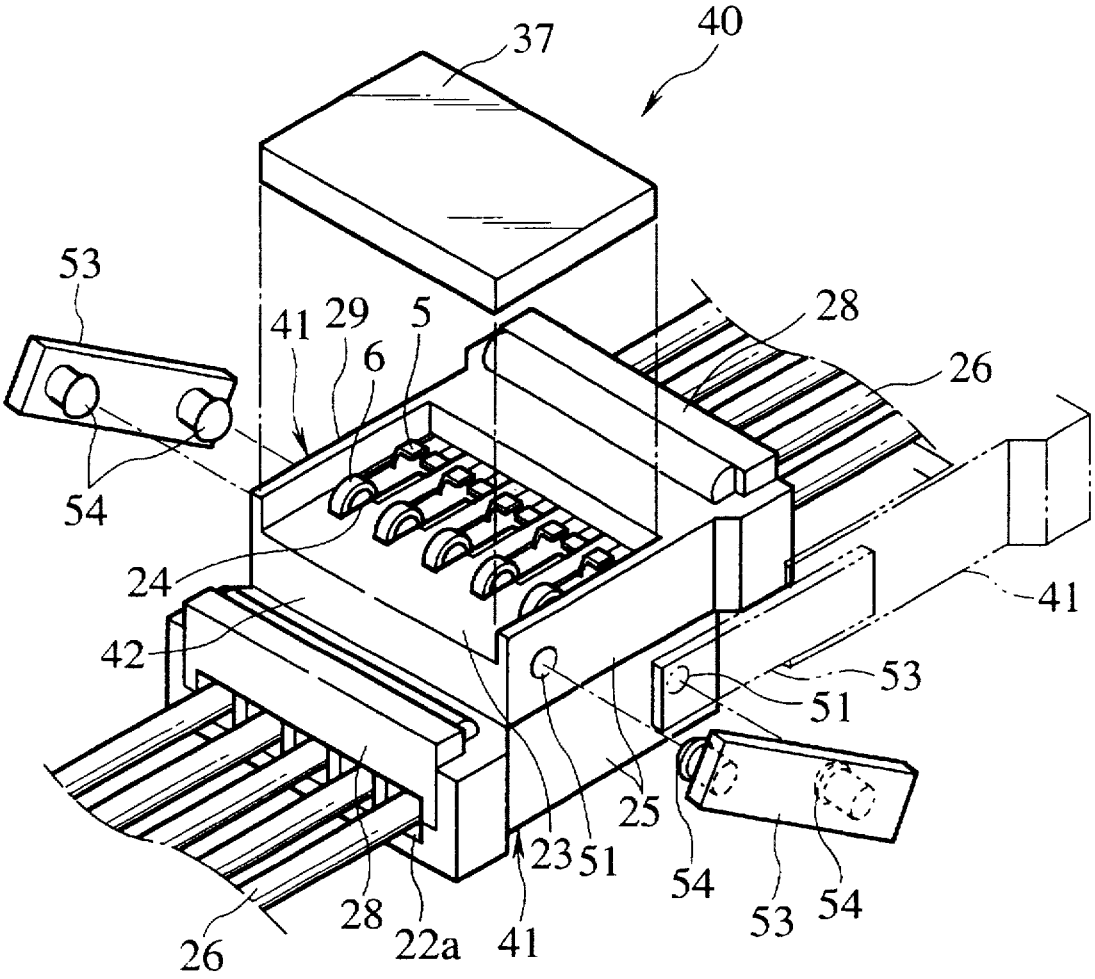
FIG. 2 is an exploded perspective view of a connector apparatus according to a second embodiment of the present invention.

FIG. 2 shows a connector apparatus according to a second embodiment reverse to the first embodiment. A connector apparatus 40 comprises an engaging bore 51 passing through a side wall 25 of a connector housing 42 in both connectors 41, and an engaging pin 54 at either end of a coupling member 53. It is possible to obtain the same effect of the second embodiment as that of the first embodiment.

What is claimed is:

1. A connector apparatus comprising:

first and second connectors, each having a connector housing including upper and lower surfaces, wherein a terminal remains accommodated in a terminal accommodating room of the connector housing, and an electric contactor of said terminal is outwardly exposed through an upper opening in the upper surface of said connector housing; and a coupling member having two ends, wherein each end of said coupling member is rotatably engaged with a respective side wall of a connector housing of one of said first and second connectors so as to couple said first and second connectors to one another in a manner permitting the coupled connectors to move from a first position, wherein said connectors lie in the same plane, to a second overlapping position, wherein the upper surface of the connector housing of one of said first and second connectors is covered by and in contact with the lower surface of the other of said first and second connectors.

2. The connector apparatus of claim 1, further comprising a detachable protecting cover for covering said electric contactor of the uppermost connector in the overlapping position.

3. The connector apparatus of claim 1, further comprising a plurality of terminals arranged in each respective connector, so that terminal arrangements of the connectors are parallel to one another when arranging said two connectors to lie in a plane.

4. The connector apparatus of claim 1, further comprising two connecting portions between a side wall of said connector housing and said coupling member, wherein an engaging bore forms one of said connecting portions and an engaging protrusion portion is mounted in the other connecting portion, so that the engaging protrusion portion can be rotatably engaged by said engaging bore and detached from said engaging bore flexibly.

* * * * *